US007556517B2

(12) United States Patent
Smadi et al.

(10) Patent No.: US 7,556,517 B2
(45) Date of Patent: Jul. 7, 2009

(54) ATTENUATION OF AN ELECTROSTATIC CHARGE ON A CABLE PRIOR TO COUPLING THE CABLE WITH AN ELECTRONIC SYSTEM

(75) Inventors: Mithkal M. Smadi, Round Rock, TX (US); Anthony C. Spielberg, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/147,316

(22) Filed: Jun. 26, 2008

(65) Prior Publication Data

US 2008/0311773 A1 Dec. 18, 2008

Related U.S. Application Data

(63) Continuation of application No. 11/764,662, filed on Jun. 18, 2007, now Pat. No. 7,407,400.

(51) Int. Cl.
*H01R 29/00* (2006.01)

(52) U.S. Cl. ..... 439/188; 439/88; 439/181

(58) Field of Classification Search ..... 439/188, 439/88, 181, 95, 98, 924.1, 924.2
See application file for complete search history.

(56) References Cited

U.S. PATENT DOCUMENTS

| | | | |
|---|---|---|---|
| 4,152,041 | A | 5/1979 | Hollyday et al. |
| 4,179,178 | A | 12/1979 | Bachman et al. |
| 4,283,102 | A | 8/1981 | Richier |
| 4,568,133 | A | 2/1986 | Amano et al. |
| 4,780,604 | A | 10/1988 | Hasegawa et al. |
| 4,849,944 | A | 7/1989 | Matsushita |
| 4,952,758 | A | 8/1990 | Dara et al. |
| 5,088,931 | A | 2/1992 | Niciolo et al. |

(Continued)

FOREIGN PATENT DOCUMENTS

| | | | |
|---|---|---|---|
| DE | 4111049 | A1 | 10/1991 |

(Continued)

OTHER PUBLICATIONS

U.S. Appl. No. 60/275,045, filed Mar. 12, 2001, Bohbot, M.

(Continued)

*Primary Examiner*—Hae Moon Hyeon
(74) *Attorney, Agent, or Firm*—Steven Lieske Bennett; Schubert Osterrieder & Nickelson PLLC

(57) ABSTRACT

Embodiments may include connectors with discharge elements integrated into the connectors to interconnect conductors of a cable to attenuate or discharge an electrostatic charge built up on the conductors. In some embodiments, the conductors are momentarily connected to ground as the connector couples with another connector to interconnect a cable with, e.g., a computer. In further embodiments, the discharge elements interconnect the conductors of a cable to redistribute an electrostatic charge and thereby minimize the impact of a discharge when the cable couples with an electronic system such as a computer. Another embodiment comprises a male connector with discharge elements, which ground conductors of the cable as the cable is being inserted into the connector. The discharge elements are pushed out of the way of the conductors as the conductors couple with the connector.

9 Claims, 7 Drawing Sheets

U.S. PATENT DOCUMENTS

| | | | | |
|---|---|---|---|---|
| 5,164,880 | A | 11/1992 | Cronin | |
| 5,220,139 | A | 6/1993 | Leleve | |
| 5,244,397 | A | 9/1993 | Anhalt | |
| 5,259,777 | A | 11/1993 | Schuder et al. | |
| 5,490,033 | A | 2/1996 | Cronin | |
| 5,812,357 | A | 9/1998 | Johansen et al. | |
| 5,947,773 | A | 9/1999 | Karam | |
| 6,151,202 | A | 11/2000 | Mueller et al. | |
| 6,390,839 | B2 | 5/2002 | Miwa | |
| 6,648,661 | B1 | 11/2003 | Byrne et al. | |
| 6,663,402 | B1 | 12/2003 | Yu | |
| 6,780,035 | B2 | 8/2004 | Bohbot | |
| 6,790,097 | B1 | 9/2004 | Edwards et al. | |
| 6,955,551 | B2 | 10/2005 | Yamamoto | |
| 7,254,005 | B2 * | 8/2007 | Oyama | 361/220 |
| 2003/0011375 | A1 | 1/2003 | Deleu et al. | |

FOREIGN PATENT DOCUMENTS

| | | | |
|---|---|---|---|
| EP | 0233649 | B1 | 8/1987 |
| EP | 0260808 | B1 | 3/1988 |
| EP | 0501749 | B1 | 9/1992 |
| EP | 0661912 | B1 | 7/1995 |
| WO | WO 98/16954 | A1 | 4/1998 |
| WO | WO 02/073741 | A2 | 9/2002 |

OTHER PUBLICATIONS

ISR including PCT transmittal & Written Opinion, From the International Searching Authority, mailed Feb. 9, 2007, Applicant: International Business Machines Corporation, International Application No. PCT/EP2006/067943, pp.—12.

* cited by examiner

ATTENUATION OF AN ELECTROSTATIC CHARGE ON A CABLE PRIOR TO COUPLING THE CABLE WITH AN ELECTRONIC SYSTEM

CROSS-REFERENCE TO RELATED APPLICATION

This application is a continuation of U.S. patent application Ser. No. 11/764,662, now U.S. Pat. No. 7,407,400 entitled "METHODS AND ARRANGEMENTS TO ATTENUATE AN ELECTROSTATIC CHARGE ON A CABLE PRIOR TO COUPLING THE CABLE WITH AN ELECTRONIC SYSTEM", filed on Jun. 18, 2007, the disclosure of which is incorporated herein in its entirety for all purposes.

BACKGROUND

The present invention is in the field of cable connections for electronic systems. More particularly, the present invention relates to methods and arrangements to attenuate an electrostatic charge of a cable prior to connecting with a connector on an electronic system such as a computer system.

Any time a cable is connected to a computer system (e.g., through USB, FireWire, or other common input/output ports) there is a risk of damage to the system resulting from a Cable Discharge Event (CDE.) A CDE results from static charge having accumulated on the cable and being discharged to the computer system when the cable is connected to the computer system. For example, in many office settings, personnel may be moved from one location to another to re-task the personnel, move locations, or the like. Computers for the personnel may be moved along with the personnel and reconnected to a network at the new location. Moving cable with a isolated pins and shielding can often build up an electrostatic charge as the cables rub against one another, rub against the carpet or wall, or even as materials within the cable rub against one another.

Electrostatic charges that build up on the cables can vary significantly in voltage depending upon the relative humidity and the materials involved. For instance, just walking across a carpeted area when the relative humidity is about 65% to 90% can typically generate an electrostatic charge of 1,500 volts. Walking across the same carpeted area when the relative humidity is approximately 10% to 20% humidity can generate an electrostatic charge of 35,000 volts.

ESD is a serious issue in electronic systems. When a statically-charged cable is connected to an electrostatic discharge sensitive (ESDS) electronic system, there is a possibility that the electrostatic charge may discharge through sensitive circuitry in the electronic system. High voltages can damage or degrade insulating materials and, if the electrostatic discharge possesses sufficient energy, damage could occur due to localized overheating. In general, devices with finer geometries are more susceptible to damage from ESD.

Integrated circuits (ICs) are particularly susceptible to ESD, especially when considering the drive to build ICs with smaller geometries in successive generations. ICs are made from semiconductor materials such as silicon and insulating materials such as silicon dioxide, which can break down if exposed to high voltages. Manufacturers and users of ICs must take precautions to avoid this problem. Such measures include appropriate packing material, the use of conducting wrist straps and foot-straps to prevent high voltages from accumulating on workers' bodies, anti-static mats to conduct harmful electric charges away from the work area, and humidity control.

Designers of computer systems typically attempt to protect their products from CDE damage by incorporating electrostatic discharge (ESD) protection structures into the components used in their systems; in the event of a CDE, these ESD protection structures are designed to route the charge from the cable to ground and thus avoid or attenuate damage to the protected components.

In practice, however, the use of ESD protection devices on components offers only limited protection. Individual ESD structures vary in their ability to handle ESD events, and can wear out over time from handling ESD events. Severe CDEs can easily exceed the capabilities of even the best ESD protection structures and cause immediate and catastrophic damage to computer systems. For example, many ESD protection devices can handle up to approximately 2,000 volts but are damaged in the event of a higher voltage ESD.

Once a computer system has been manufactured and sold, there is no feasible option for changing its internal design or structure to improve its resistance to CDEs.

SUMMARY

The problems identified above are in large part addressed by methods and arrangements to attenuate electrostatic discharges from a cable to an electronic system. One embodiment provides an apparatus to attenuate electrostatic discharges from a cable. The apparatus may comprise a discharge element and a connector to couple with the cable to couple a conductor of the cable with the discharge element. Coupling the cable with the discharge element may reduce an electrostatic charge on the conductor of the cable prior to coupling the conductor of the cable with a conductor of the electronic system.

In many embodiments, the discharge element comprises a brush to conduct a charge. In some embodiments, the connector comprises a mounting to couple the brush in a position relative to the connector and the cable, wherein the position is to initiate contact between the brush and the conductor of the cable as the cable couples with the connector, to substantially discharge the conductor of the cable.

Another embodiment provides an electronic system to attenuate electrostatic discharges from a cable. The system may comprise an enclosure comprising circuitry and a grounding structure; a discharge element to couple a conductor of a cable with the grounding structure; and a connector coupled with the enclosure to couple the conductor of the cable with the discharge element. Coupling the cable with the discharge element may reduce an electrostatic charge on the conductor of the cable prior to coupling the conductor of the cable with the circuitry.

In many embodiments, the discharge element comprises one or more brushes to conduct a charge from the conductor of the cable to the grounding structure. In some embodiments, the connector comprises a mounting to couple the brush in a position relative to an insertion point for the cable, wherein the position is to initiate contact between the one or more brushes and the conductor of the cable as the cable connects with the connector, and to disconnect from the conductor of the cable prior to electrical contact between the conductor of the cable and the circuitry.

A further embodiment provides a method to attenuate electrostatic discharges from a cable to an electronic system. The method may involve positioning a discharge element in an insertion path of a conductor of a cable to couple the cable with a connector for an electronic system; discharging the pin to a ground of the electronic system in response to contact between the conductor of the cable and the discharge element while coupling the cable with the connector; and disconnecting the conductor of the cable from the discharge element prior to coupling the conductor of the cable with circuitry of the electronic system.

DETAILED DESCRIPTION OF EMBODIMENTS

The following is a detailed description of embodiments depicted in the accompanying drawings. However, the amount of detail offered is not intended to limit the anticipated variations of embodiments, but on the contrary, the intention is to cover all modifications, equivalents, and alternatives falling within the spirit and scope as defined by the appended claims. The detailed descriptions below are designed to make such embodiments obvious to a person of ordinary skill in the art.

Generally speaking, methods and arrangements to attenuate electrostatic discharges of a cable are contemplated. Embodiments may include connectors with discharge elements integrated into the connectors to interconnect conductors of a cable to attenuate or discharge an electrostatic charge built up on the conductors. In some embodiments, the conductors are momentarily connected to ground as the connector couples with another connector to interconnect a cable with, e.g., a computer. In further embodiments, the discharge elements interconnect the conductors of a cable to redistribute an electrostatic charge and thereby minimize the impact of a discharge when the cable couples with an electronic system such as a computer. For instance, one embodiment comprises a female connector with discharge elements, which ground each conductor of the cable as the cable is being inserted into the connector. Another embodiment comprises a male connector with discharge elements, which ground conductors of the cable as the cable is being inserted into the connector. The discharge elements are pushed out of the way of the conductors as the conductors couple with the connector.

Such embodiments may advantageously attenuate or even eliminate risk of cable discharge events (CDEs) and may be implemented at a relatively low cost. Furthermore, such embodiments may not rely on electrostatic discharge (ESD) protection on downstream components and may be transparent to the end user, requiring neither knowledge nor action by the end user. Embodiments may also be robust, substantially immune from avoidance or error, and highly reliable with minimal wear out.

While specific embodiments will be described below with reference to particular circuit and pin or conductor configurations, those of skill in the art will realize that embodiments of the present invention may advantageously be implemented with other substantially equivalent configurations and any number of pins or conductors.

Figure 1:
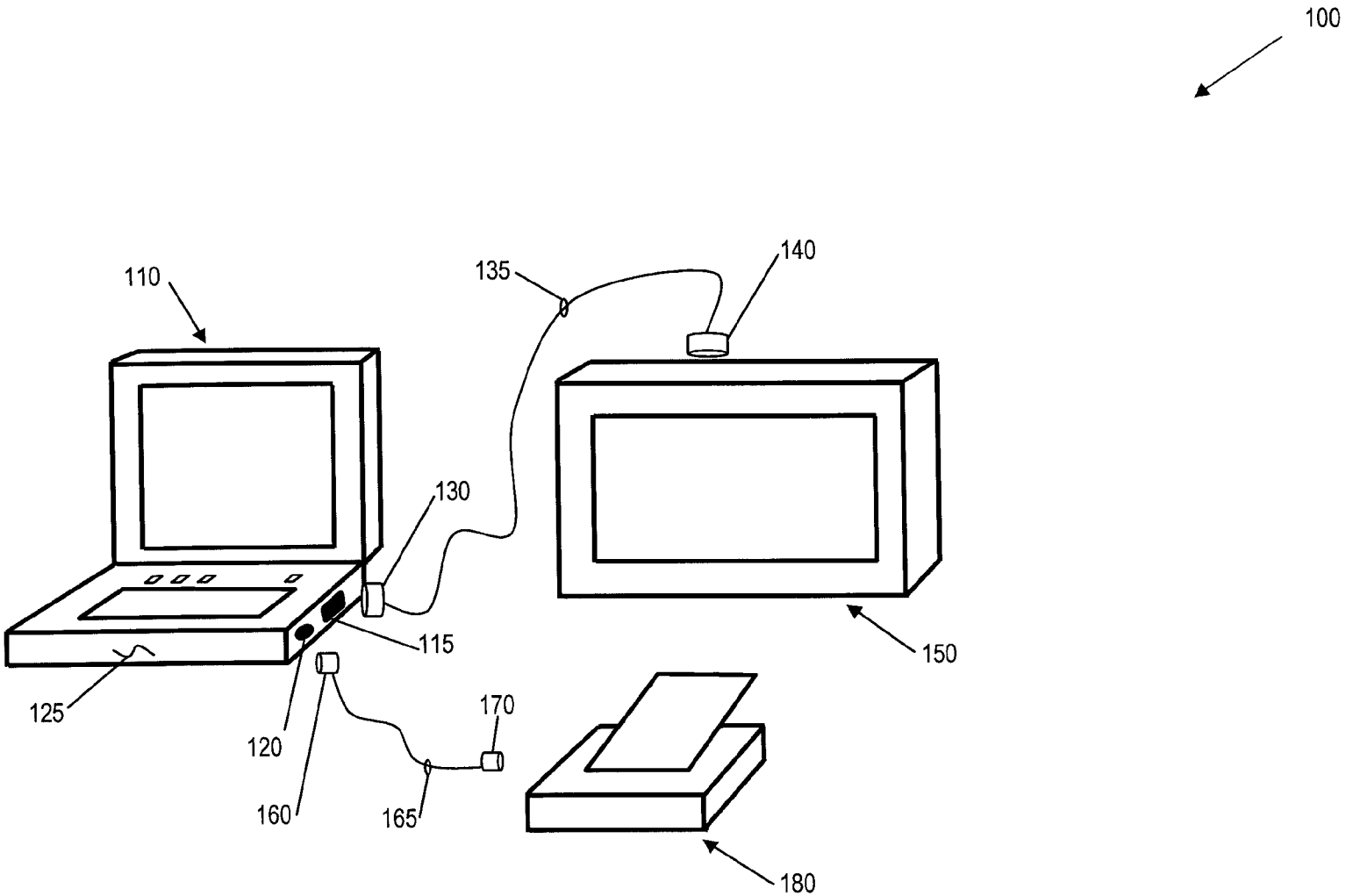
FIG. 1 depicts an embodiment of system comprising a computer, external display and a printer.

Turning now to the drawings, FIG. 1 depicts an embodiment of system 100 including a computer 110, an external display 150, and a printer 180. Cables 135 and 165 are adapted to interconnect external display 150 and printer 180, respectively, with computer 110. For instance, an employee assigned use of system 100 may move to a new location to begin a new task or project. The employee may pack up system 100 without using recommended anti-static devices and bags to prevent the build up of an electrostatic charge on the cables 135 and 165, and then reassemble system 100 at the new location. As the employee connects the parallel cable 135 with connector 115 on computer 110, connector 115 may momentarily couple the conductors of cable 135 with enclosure 125 to discharge the electrostatic charge from the conductors. Once the conductors are discharged, the conductors couple with corresponding conductors of connector 115 to facilitate communications between external display 150 and computer 110.

Computer 110 comprises an electronic system with internal circuitry that may be sensitive to electrostatic discharges from cables such as cables 135 and 165. In the present embodiment, computer 110 is depicted as a laptop but computer 110 may be a desktop, workstation, server, personal digital assistant (PDA), stereo system, digital music player, cellular phone, or any other electronic system that comprises circuitry that may be sensitive to an electrostatic discharge and includes a connector to facilitate interconnection with an external device via, e.g., a cable.

Computer 110 comprises enclosure 125, a parallel connector 115, and a serial connector 120. Enclosure 125 may comprise an electrically conductive grounding structure integrated into the enclosure, mounted interior to the enclosure, or the like. The grounding structure may act as a ground for the discharging an electrostatic charge from cables 135 and 165 without damaging circuitry.

Parallel connector 115 may be any type of electrical parallel connection and may comprise a connector with one or more brushes, filaments, or the like. The brushes, filaments, and/or the like may provide a path to discharge the electrostatic charge on cable 135. The path is more conductive than the air at the connector or has sufficient conductivity to attenuate or eliminate sparking through the air to the connector 115. For example, parallel connector 115 may include brushes positioned in an insertion path for connector 130 to contact the conductors of cable 135 as connector 130 is inserted into parallel connector 115. The brushes may remain in contact with the conductors of cable 135 sufficiently long to substantially discharge the electrostatic charge from cable 135 into a grounding system such as the grounding structure of enclosure 125. Then, the brushes may disconnect from the conductors of cable 135 to facilitate connection between the conductors of cable 135 and conductors of connector 115.

Similarly, serial connector 120 may be any type electrical serial connection such as a round or rectangular 5-pin, 7-pin, or 12-pin serial connectors. For instance, serial connector 120 may comprise a proprietary serial connector such as a universal serial bus (USB) connector and/or a FireWire connector. Serial connector 120 comprises a discharge element and a connector adapted to couple the discharge element with conductors of cable 165 as connector 160 is coupled with serial connector 120.

In some embodiments, display 150 may comprise a parallel connector such as parallel connector 115 to discharge cable 135 if connector 140 is plugged into external display 150 prior to plugging connector 130 into computer 110. Similarly, printer 180 may comprise a serial connector such as serial connector 120 to discharge any electrostatic charge on cable 165 as connector 170 is inserted into the serial connector on printer 180.

In further embodiments, one or more connectors of cable 135 and/or 165 such as connector 160 and/or 170 may comprise brushes, filaments, or the like to couple conductors of cable 165 together at least momentarily prior to connection with an electronic device. Coupling the conductors together can redistribute electrostatic charge between conductors of cable 165 to attenuate damage to an electronic device resulting from an electrostatic discharge. In some of these embodiments, the connector on the electronic device, such as connector 120 is adapted to discharge the charges to ground via a grounding connection on, e.g., connector 160.

Figure 2A:
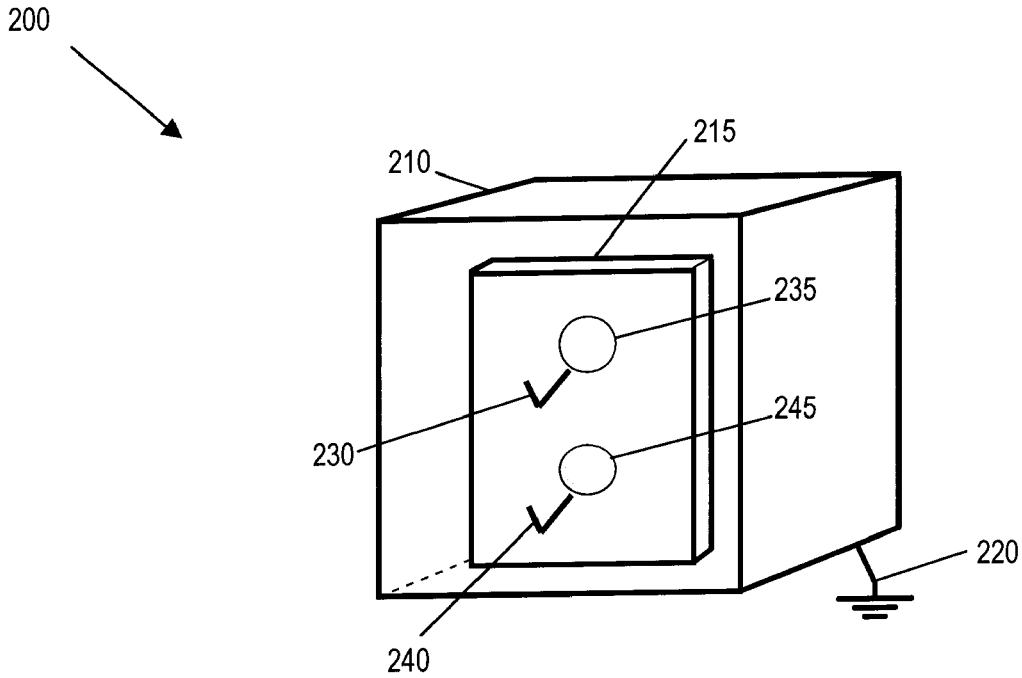
FIG. 2 depicts an embodiment of a female connector.
Figure 2B:
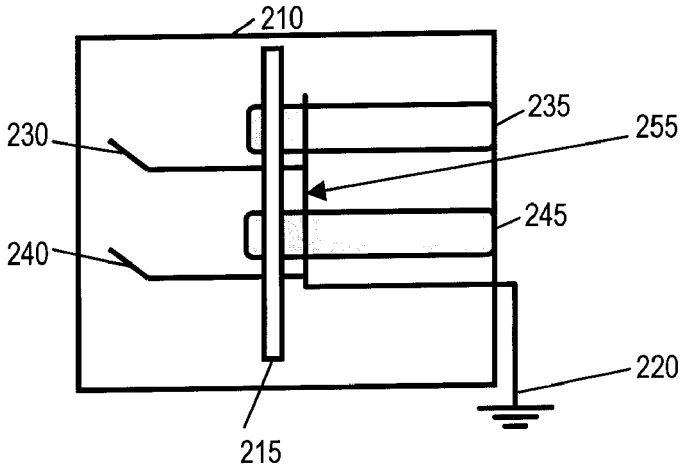
Figure 2C:
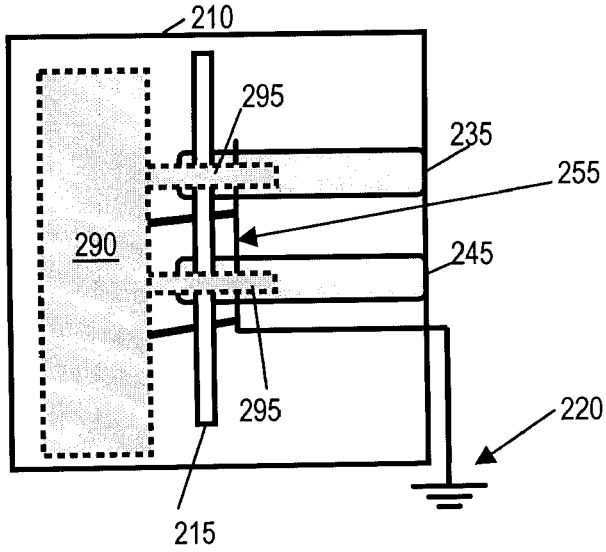

FIGS. 2A-C depict an example of a female connector 200 adapted to attenuate an electrostatic charge on a cable. Female connector 200 comprises a housing 210 coupled with a ground 220, a mounting 215, discharge elements 230 and 240, conductors 235 and 245, and isolator 255 (shown in FIGS. 2B-C). FIGS. 2A and 2B illustrate front and side views of female connector 200 respectively. FIG. 2C illustrates another side view while a cable connector 290 is being coupled with female connector 200.

Housing 210 may couple female connector 200 with a ground for an electronic device. For example, housing 210 may couple with an enclosure of the electronic device. In some embodiments, housing 210 may comprise a socket defining a unique shape for the connection to deter coupling female connector 200 with incompatible cables. In further embodiments, housing 210 may form a socket shaped to hold an interconnection between a cable and female connector 200 together once the connection is established.

Mounting 215 couples with discharge elements 230 to hold the discharge elements in position while a cable connection (illustrated in FIG. 2C) is initially being established. Mounting 215 may also isolate conductors 235 and 245 from the conductors of a cable to prevent or attenuate electrostatic discharge to circuitry of the electronic device.

The position of the discharge elements 230 and 240 may maintain the discharge elements 230 and 240 in the paths of male pins 295 of the cable connector 290 so that the discharge elements 230 and 240 will contact the male pins 295 as cable connector 290 is inserted into housing 210. Discharge elements 230 and 240 contact male pins 295 while discharge elements 230 and 240 are in contact with isolator 255 (shown in FIGS. 2B-C) to discharge an electrostatic charge on pins 295 to ground 220.

In the present embodiment, after discharge elements 230 and 240 contact male pins 295, discharge elements are pushed out of the way of the connection between the male pins 295 and conductors 235 and 245 as shown in FIG. 2C. In further embodiments, discharge elements 230 and 240 may be disconnected from ground 220.

In other embodiments, female connector 200 may permanently or temporarily couple with one or more ends of a cable to redistribute electrostatic charge amongst corresponding conductors of the cable to attenuate the magnitude of a discharge event. Redistribution of the charge should equalize the electrostatic charge on each conductor when given sufficient time, such as a fraction of a second. In such embodiments, housing 210 may not couple with ground 220 or may couple with ground 220 upon coupling female connector 200 with an electronic device such as computer 110 of FIG. 1.

Note also that many of the FIGs illustrate two conductor connections for cables and connectors for ease and clarity. However, embodiments may have one or more conductors. For instance, USB 1.1 and 2.0 compliant connectors have four conductors and a shield. Such embodiments comprise one or more discharge elements in the path of the four conductors to at least momentarily ground the conductors. The shield, which is the fifth conductor, would also be grounded in a similar manner in several embodiments.

Figure 3A:
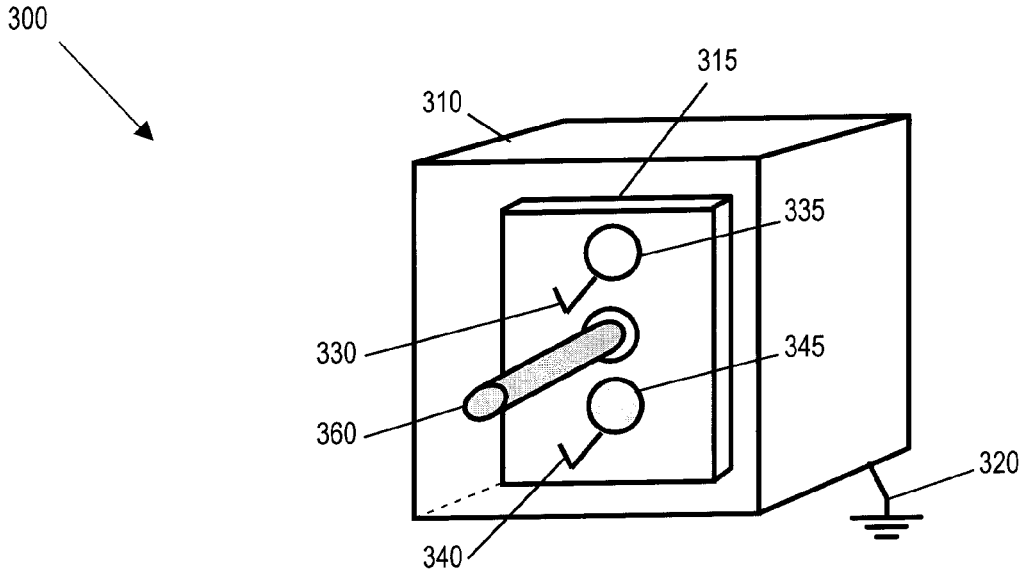
FIG. 3 depicts a different embodiment of a female connector.
Figure 3B:
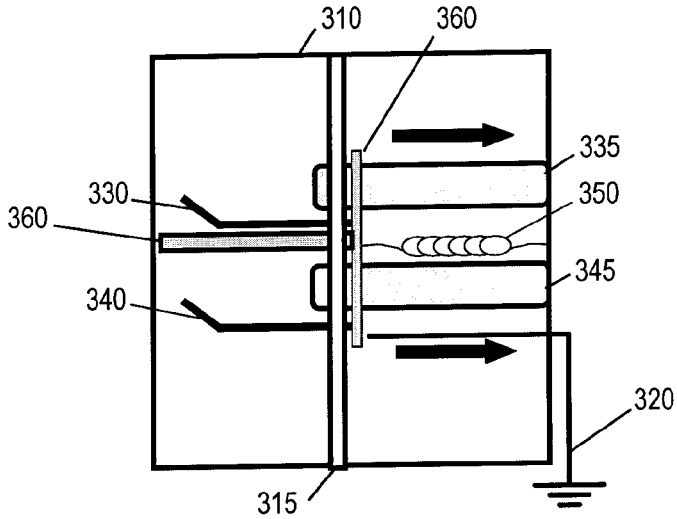
Figure 3C:
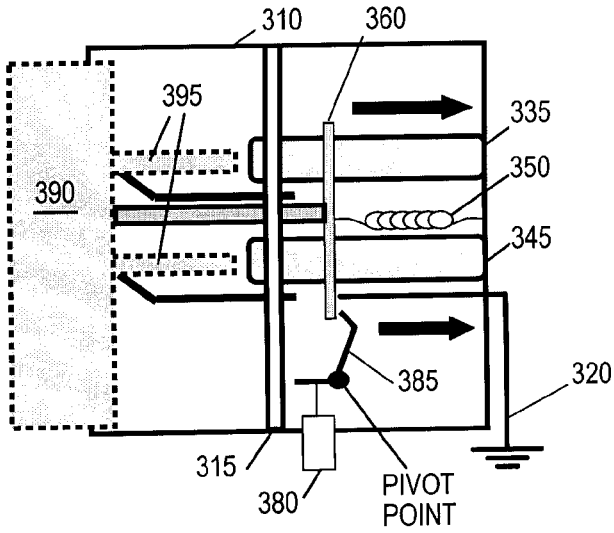

FIGS. 3A-C depict an example of a female connector 300 adapted to attenuate an electrostatic charge on a cable. Female connector 300 comprises a housing 310 coupled with a ground 320, a mounting 315, discharge elements 330 and 340, conductors 335 and 345, and an isolator 360 coupled with a spring 350 (shown in FIGS. 3B-C). FIGS. 3A and 3B illustrate front and side views of female connector 300 respectively. FIG. 3C illustrates another side view while a cable connector 390 is being coupled with female connector 300.

Similar to housing 210, housing 310 may couple female connector 300 with a ground for an electronic device. Mounting 315 couples with discharge elements 330 and 340 to hold the discharge elements in position while a cable connector 390 (illustrated in FIG. 3C) is being coupled with female connector 300. Unlike mounting 215, mounting 315 does not move when a cable is connected. Instead, isolator 360 is adapted to contact cable connector 390 after substantially discharging male pins 395 to decouple discharge elements 330 and 340 from ground 320.

In the present embodiment, as illustrated in FIG. 3C, a button 380 may need to be depressed (or a switch actuated) to allow contact cable connector 390 to physically contact the conductors 335 and 345 of female connector 300. Depression of button 380 simply moves a member 385 out of the way via a pivot point to facilitate contact. Button 380 may also be spring-loaded so that the button will automatically return to a position that prevents connection with the cable once the cable is disconnected.

Spring 350 couples with isolator 360 to re-couple discharge elements 330 and 340 with ground 320 after cable connector 390 is disconnected from female connector 300. Further embodiments may comprise a spring such as spring 350 coupled between mounting 315 and isolator 360 to restore contact between isolator 360 and discharge elements 330 and 340.

Figure 4A:
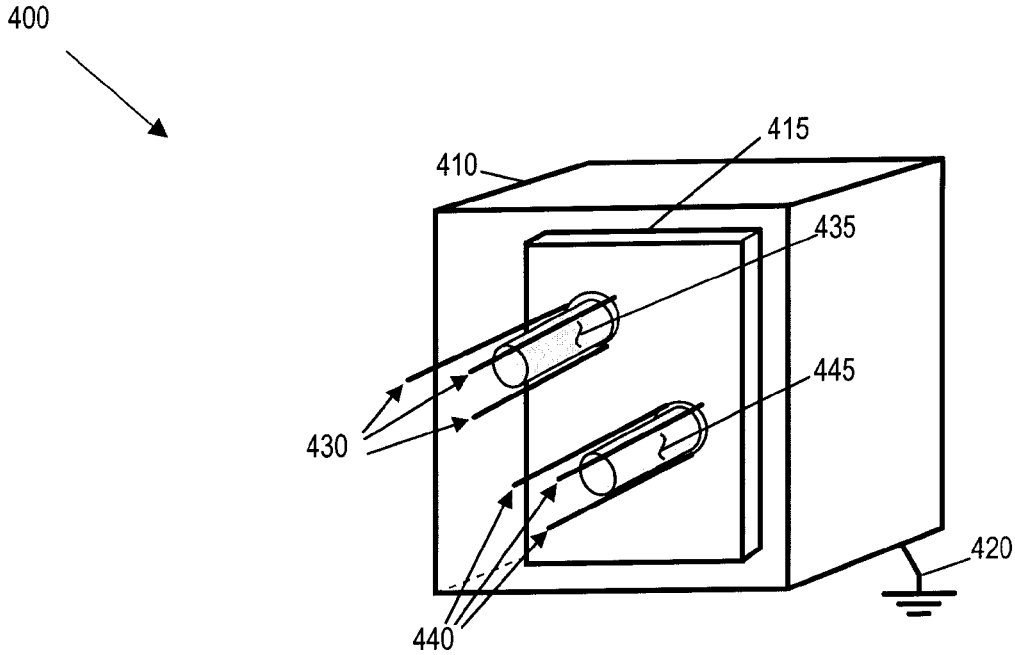
FIG. 4 depicts an embodiment of a male connector.
Figure 4B:
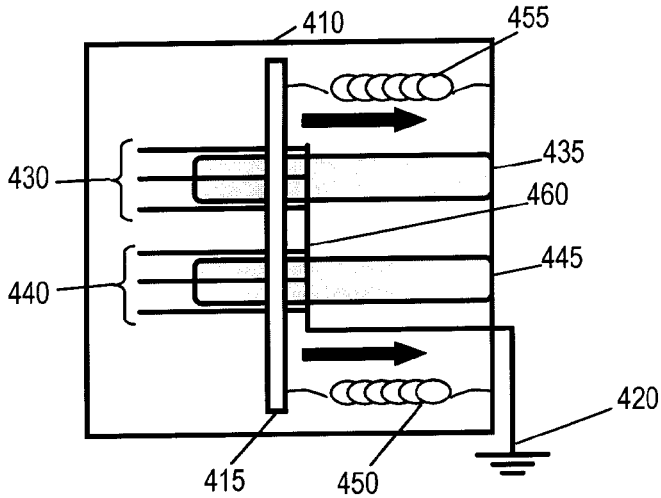
Figure 4C:
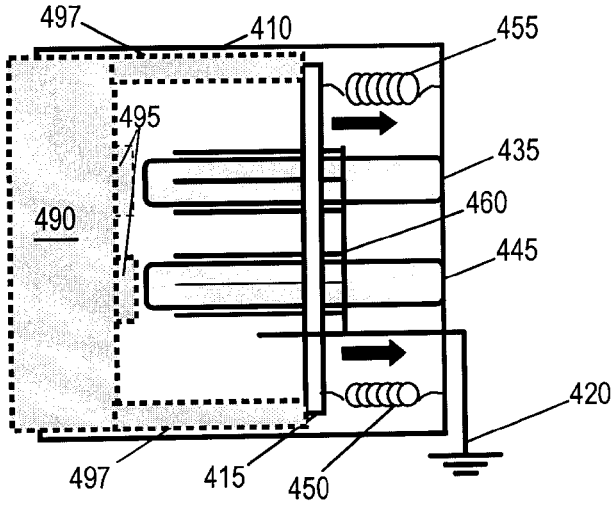

FIGS. 4A-C depict an example of a male connector 400 adapted to attenuate an electrostatic charge on a cable. Male connector 400 comprises a housing 410 coupled with a ground 420, a mounting 415, discharge elements 430 and 440, conductors 435 and 445, and an isolator 460 coupled with springs 450 and 455 (shown in FIGS. 4B-C). FIGS. 4A and 4B illustrate front and side views of male connector 400 respectively. FIG. 4C illustrates another side view while a cable connector 490 is being coupled with male connector 400.

Similar to housing 210, housing 410 may couple male connector 400 with a ground for an electronic device and define a shape within which cable connector 490 fits to prevent interconnections between incorrect conductors. Mounting 415 couples with discharge elements 430 and 440 to hold the discharge elements 430 and 440 in position while a cable connection (illustrated in FIG. 4C) is initially being established. Mounting 415 contacts members 497 of cable connector 490 after discharge elements 430 and 440 contact cable conductors 495 to move discharge elements out of the way of an interconnection between cable connector 490 and conductors 435 and 445.

Springs 450 and 455 couple with isolator 460 to re-position discharge elements 430 and 440 in the insertion path of conductors 495 as cable connector 490 is disconnected from male connector 400. In further embodiments, members 497 may rotate mounting 415 to move discharge elements 430 and 440 out of the way of the connection or otherwise disconnect or isolate discharge elements 430 and 440 from conductors 495.

In other embodiments, male connector 400 may permanently or temporarily couple with one or more ends of a cable to redistribute electrostatic charge amongst corresponding conductors of the cable to attenuate the magnitude of a discharge event. In such embodiments, housing 410 may not couple with ground 420 or may couple with ground 420 upon coupling male connector 400 with an electronic device such as computer 110 of FIG. 1.

Figure 5A:
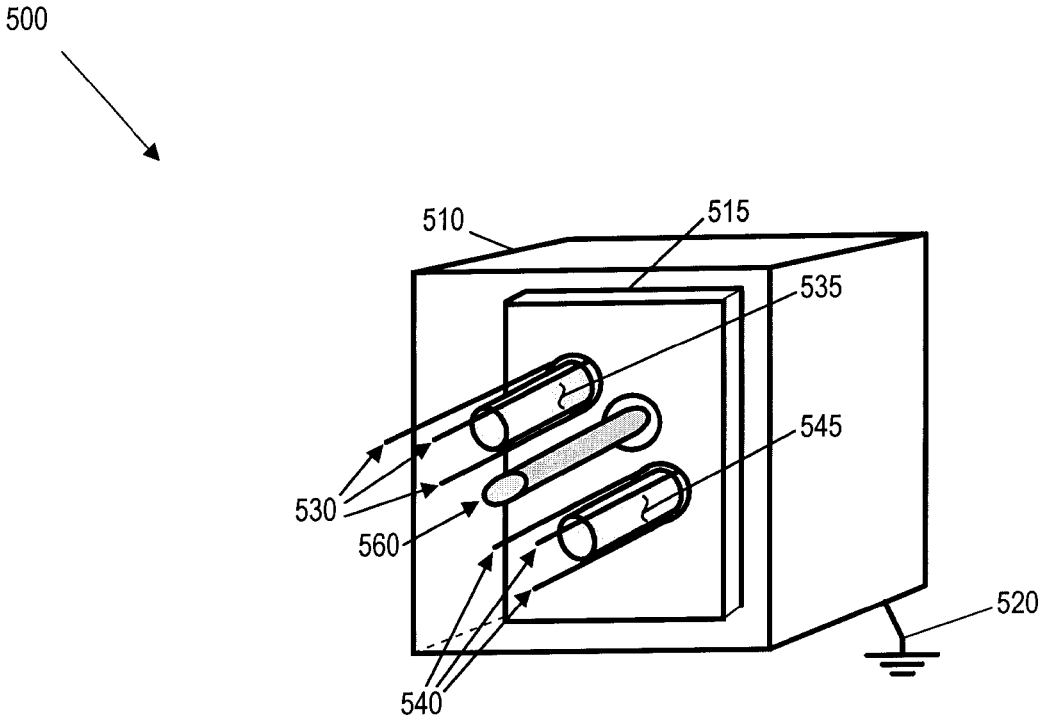
FIG. 5 depicts another embodiment of a male connector.
Figure 5B:
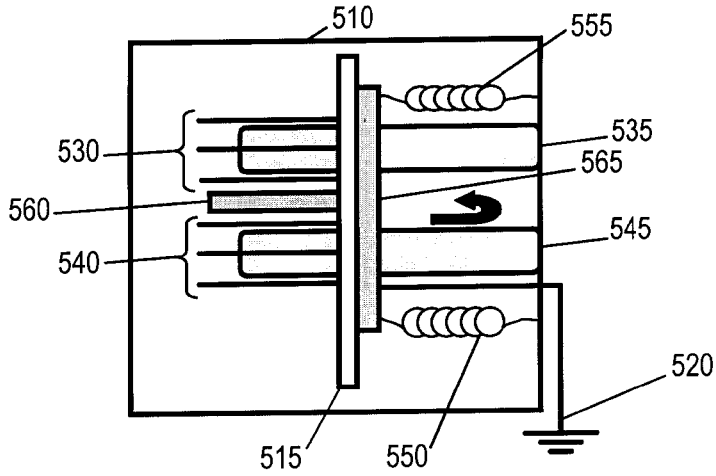
Figure 5C:
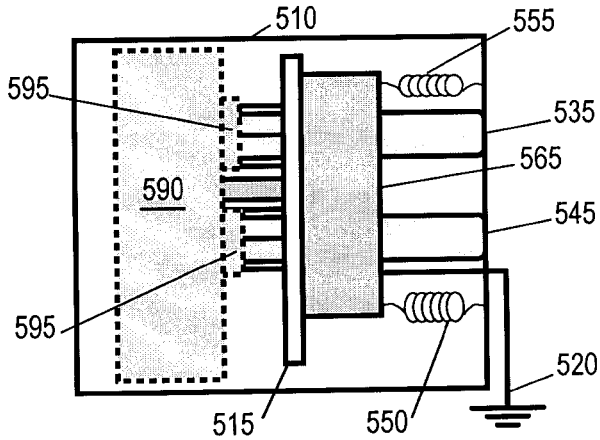

FIGS. 5A-C depict an example of a male connector 500 adapted to attenuate an electrostatic charge on a cable. Male connector 500 comprises a housing 510 coupled with a ground 520, a mounting 515, discharge elements 530 and 540, conductors 535 and 545, and an isolator 560 and 565 coupled with springs 550 and 555 (shown in FIGS. 5B-C). FIGS. 5A and 5B illustrate front and side views of male connector 500 respectively. FIG. 5C illustrates another side view while a cable connector 590 is being coupled with male connector 500.

Housing 510 may couple male connector 500 with a ground 520 for an electronic device. Mounting 515 couples with discharge elements 530 and 540 to hold the discharge elements 530 and 540 in position while a cable connection 590 (illustrated in FIG. 5C) is inserted. Isolator member 560 contacts cable connector 590 after discharge elements 530 and 540 contact cable conductors 595 to disconnect discharge elements 530 and 540 from ground 520. In particular, isolator member 560 rotates isolator member 565 as cable connector 590, which disconnects discharge elements 530 and 540 from isolator member 565, pushes isolator member 565.

Springs 550 and 555 couple with isolator member 565 to re-couple discharge elements 530 and 540 with ground 520 as cable connector 590 is disconnected from male connector 500. Isolator member 565 may couple with mounting 515 via a rotatable hinge. In some embodiments, isolator member 560 may couple with isolator member 565 via a rotatable hinge.

Figure 6A:
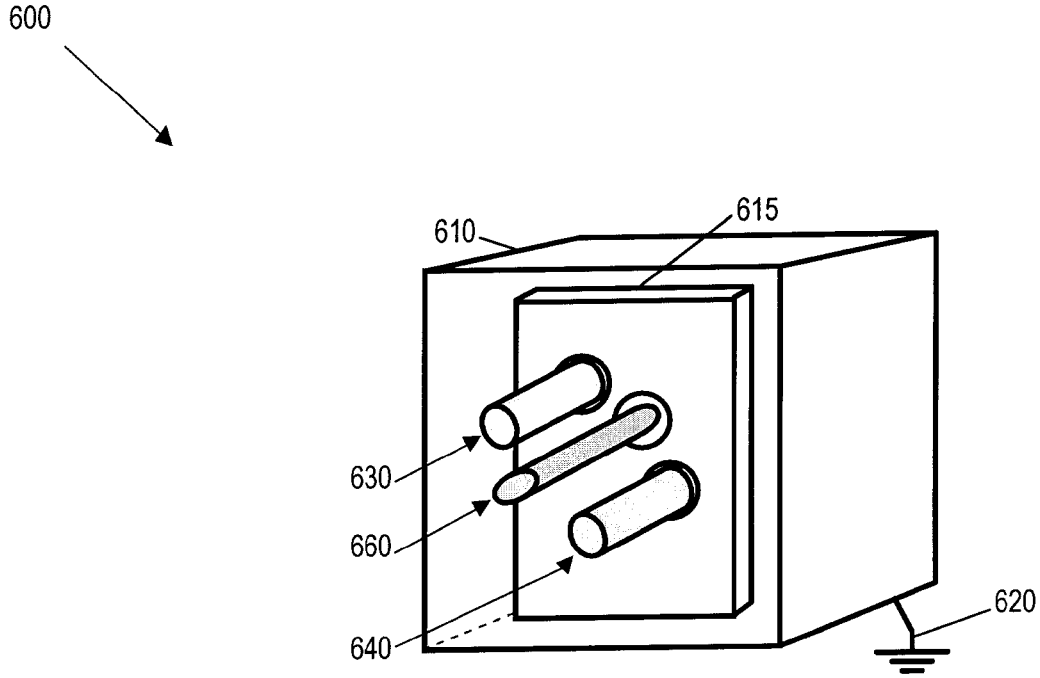
FIG. 6 depicts a further embodiment of a male connector.
Figure 6B:
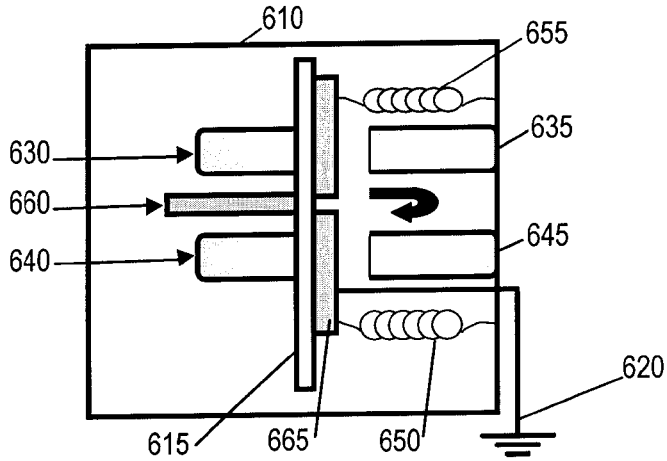
Figure 6C:
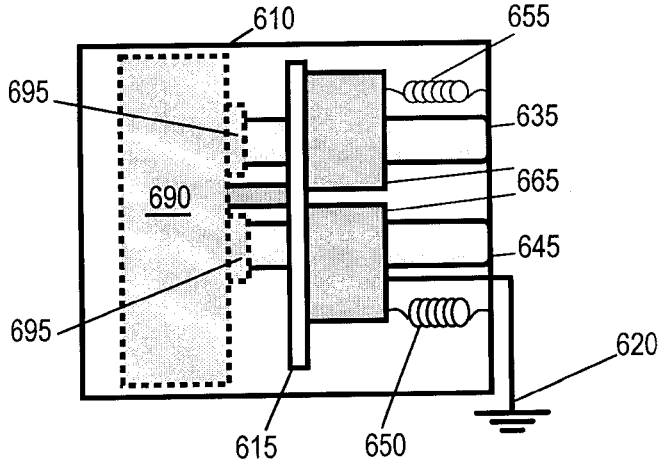

FIGS. 6A-C depict an example of a male connector 600 adapted to attenuate an electrostatic charge on a cable. Male connector 600 comprises a housing 610 coupled with a ground 620, a mounting 615, discharge elements 630 and 640, conductors 635 and 645, and an isolator 660 and 665 coupled with springs 650 and 655 (shown in FIGS. 6B-C). FIGS. 6A and 6B illustrate front and side views of male connector 600 respectively. FIG. 6C illustrates another side view while a cable connector 690 is being coupled with male connector 600.

Housing 610 may couple male connector 600 with a ground 620 for an electronic device. Mounting 615 couples with discharge elements 630 and 640 to hold the discharge elements 630 and 640 in position while a cable connection 690 (illustrated in FIG. 6C) is inserted. Isolator member 660 contacts cable connector 690 after discharge elements 630 and 640 contact cable conductors 695 to disconnect discharge elements 630 and 640 from ground 620 and to couple conductors 635 and 645 with conductors 630 and 640 respectively. In particular, isolator member 660 rotates isolator members 665 as cable connector 690 is inserted, which disconnects discharge elements 630 and 640 from ground 620.

Springs 650 and 655 couple with isolator members 665 to re-couple discharge elements 630 and 640 with ground 620 as cable connector 690 is disconnected from male connector 600. Isolator members 665 may couple with mounting 615 via rotatable hinges.

Figure 7:
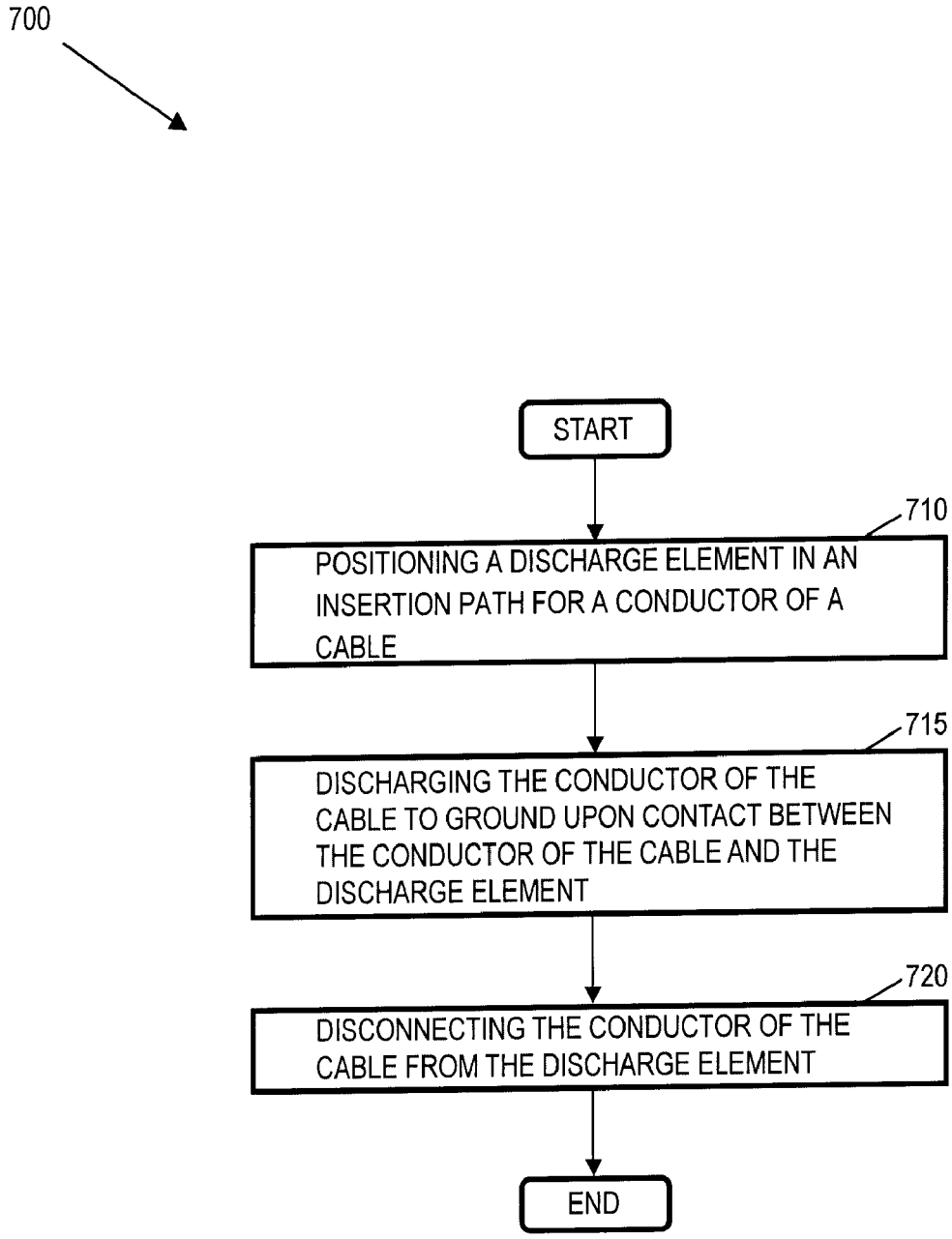
FIG. 7 depicts a flowchart of an embodiment to attenuate electrostatic discharges of a cable.

Referring now to FIG. 7, there is shown a flowchart 700 of an embodiment to attenuate an electrostatic charge of a cable. Flowchart 700 begins with positioning a discharge element in an insertion path of a conductor of a cable to couple the cable with a connector for an electronic system (element 710). Positioning the discharge element in the insertion path may entail maintaining a position of the discharge element in the insertion path or mounting the discharge element so that the discharge element remains in the path. For example, the discharge element may be coupled with a mounting to hold the discharge element. The mounting may be temporarily or permanently positioned such that the discharge element will contact a conductor of a compatible cable connector before the conductor touches a conductor for the electronic device.

In some embodiments, one or more springs may couple with the mounting to hold the mounting temporarily in position. In many such embodiments, the mounting is capable of moving the discharge element away from the insertion path as a cable is connected to the electronic device to facilitate a clean connection between the cable and the electronic device. Such embodiments may also move the discharge element back into the insertion path as the cable is disconnected from the electronic device.

Once the discharge elements are in place, flowchart 700 continues with discharging the conductor to a ground of the electronic system in response to contact between the conductor of the cable and the discharge element (element 715). In particular, discharging the conductor may interconnect the conductor of the cable and other conductors of the cable with a grounding structure of the electronic system. For instance, as the cable connector is coupled with a connector on the electronic device, the discharge elements in the insertion path for the cable connector may contact the conductors of the cable. Upon contact with the discharge elements, any electrostatic charge built up on the conductors begins to discharge through the discharge elements to ground.

Many embodiments are adapted to thoroughly discharge the conductors of the cable prior to decoupling the conductors from the discharge elements. In some embodiments, less than all of the electrostatic charge may be discharged prior to coupling the cable with the electronic device.

After discharging the conductors of the cable, the discharge elements are disconnected from the conductor of the cable (element 720). In some embodiments, the discharge elements are disconnected prior to connecting the conductors of the cable with conductors of the electronic device. In further embodiments, the discharge elements are disconnected while connecting the conductors of the cable with conductors of the electronic device. And, in other embodiments, the discharge elements are disconnected after connecting the conductors of the cable with conductors of the electronic device.

Disconnecting the discharge elements from the conductors of the cable may involve repositioning a member coupled with the discharge elements. For example, an isolator member that couples the discharge elements with ground may be repositioned to disconnect the discharge elements from ground and/or couple the discharge elements with conductors of the electronic system.

It will be apparent to those skilled in the art having the benefit of this disclosure that the present invention contemplates methods and arrangements to attenuate an electrostatic charge of a cable. It is understood that the form of the invention shown and described in the detailed description and the drawings are to be taken merely as examples. It is intended that the following claims be interpreted broadly to embrace all the variations of the example embodiments disclosed.

Although the present invention and some of its advantages have been described in detail for some embodiments, it should be understood that various changes, substitutions and alterations can be made herein without departing from the spirit and scope of the invention as defined by the appended claims. Although an embodiment of the invention may achieve multiple objectives, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A connector to attenuate electrostatic discharges from a cable to an electronic system, the connector comprising:

at least one discharge element;

a button; and a housing to attach to the electronic system to couple with a connector of the cable to interconnect the electronic system with the cable, the housing coupled with the button, wherein the housing comprises a mounting coupled with the at least one discharge element to position the at least one discharge element to couple with at least one conductor of the cable to reduce an electrostatic charge on the at least one conductor of the cable, the connector responsive to depression of the button to couple the at least one conductor of the cable with circuitry of the electronic system.

2. The connector of claim 1, further comprising a switch coupled with the housing wherein the button, upon depression, is adapted to actuate the switch, wherein actuation of the switch is to couple the at least one conductor of the cable with the circuitry of the electronic system.

3. The connector of claim 1, wherein the at least one discharge element comprises a material with sufficient conductivity to avoid a discharge of the electrostatic charge from the at least one conductor of the cable to the circuitry of the electronic system as the connector of the cable couples with the connector of the electronic system.

4. The connector of claim 1, wherein the at least one discharge element comprises at least two electrically interconnected brushes.

5. The connector of claim 1, wherein the mounting is to move in response to contact with the connector of the cable to disconnect at least one discharge element from the at least one conductor of the cable.

6. The connector of claim 1, wherein the mounting is to couple the at least one discharge element in a position relative to an insertion point for the cable, wherein the position is to initiate contact between the at least one discharge element and the at least one conductor of the cable as the connector of the cable connects with the housing, and to disconnect from the at least one conductor of the cable prior to electrical contact between the at least one conductor of the cable and the circuitry of electronic system.

7. The connector of claim 1, wherein the housing comprises an isolator to couple with the at least one discharge element, wherein the button is to disconnect the at least one discharge element from the isolator upon depression of the button.

8. The connector of claim 1, wherein the housing comprises an isolator, wherein the isolator has a first position and a second position, the first position to interconnect the at least one conductor of the cable with the at least one discharge element, and the second position to separate the at least one discharge element from the at least one conductor of the cable.

9. The connector of claim 1, wherein the housing comprises a grounding connection to couple the housing with a corresponding grounding connection on the electronic system to discharge the electrostatic charge to ground of the electronic system prior to coupling the at least one conductor of the cable with the circuitry of the electronic system.

* * * * *